US005916345A

United States Patent [19]

Kobayashi

[11] Patent Number: 5,916,345

[45] Date of Patent: Jun. 29, 1999

[54] TOGGLE-TYPE PUNCH DRIVE APPARATUS

[75] Inventor: Hiroshi Kobayashi, Niwa-gun, Japan

[73] Assignee: Murata Kikai Kabushiki Kaisha, Kyoto, Japan

[21] Appl. No.: 08/864,834

[22] Filed: May 29, 1997

Related U.S. Application Data

[63] Continuation of application No. 08/450,265, May 25, 1995, abandoned.

[30] Foreign Application Priority Data

Jun. 14, 1994 [JP] Japan ..... 6-156806

[51] Int. Cl.[6] ..... B26D 5/18

[52] U.S. Cl. ..... 83/543; 83/628; 83/630; 72/451; 100/272; 100/281

[58] Field of Search ..... 83/543, 628, 630, 83/632; 72/451; 100/272, 281, 286

[56] References Cited

U.S. PATENT DOCUMENTS

| | | | |
|---|---|---|---|
| 116,420 | 6/1871 | Duff | 83/630 X |
| 3,529,502 | 9/1970 | Krynytzky et al. | 83/454 X |
| 3,724,308 | 4/1973 | Nichols | 83/630 X |
| 4,301,723 | 11/1981 | Borzym | 83/630 X |
| 4,303,012 | 12/1981 | McGlennon | 100/272 |
| 4,664,004 | 5/1987 | Randall | 83/630 X |

FOREIGN PATENT DOCUMENTS

| | | | |
|---|---|---|---|
| 1 062 043 | 7/1959 | Germany | 83/630 |
| 2 252 953 | 5/1974 | Germany | 100/281 |

*Primary Examiner*—Clark F. Dexter
*Attorney, Agent, or Firm*—Loeb & Loeb LLP

[57] ABSTRACT

The top and bottom ends of a pivoting lever, which is pivotable in the middle, are rotatably connected with a supporting component and a ram, respectively. A shuttle component is linked with the pivot point of the pivoting lever. The shuttle component drives the pivoting lever forcing it to pivot, and when the shuttle component reaches the midpoint of the stroke the pivoting is fully extended. The shuttle component is shuttled by way of a crank, utilizing a servomotor as the drive source. The ram drives the punching tool and is held by the frame in the way that it can readily make the up and down motion.

8 Claims, 3 Drawing Sheets

TOGGLE-TYPE PUNCH DRIVE APPARATUS

This is a continuation of application Ser. No. 08/450,265 filed on May 25, 1995, now abandoned.

BACKGROUND OF THE INVENTION

1. Technical Field

The present invention relates to a punch drive apparatus equipped in a punching press machine.

2. Background Art

In a conventional mechanical punch press machine as a punch drive apparatus which produces up and down motion of a ram, a crank drive apparatus has been used wherein the bottom end of a pitman arm connected with the crank shaft is engaged with a ram. In this mechanism, one rotation of the crank shaft generates one up and down motion of the ram. Therefore rotational velocity of the crank shaft must be increased in order to reduce processing time by high-speed punching. However, increasing punching speed is not easy to achieve because the rotational velocity of the crank shaft is limited according to the rotational velocity of the motor or the characteristics of a shaft bearing. Even if increasing the rotation velocity of the crank shaft is possible, that approach would increase the noise during the punching operation. Further, since the crank moves fastest at the midpoint of the up-down stroke and slowest near the top and bottom dead points in the crank drive apparatus described above, the stroke velocity near the bottom dead point after the punching tool actually hits a workpiece is slow, causing difficulty in achieving an adequate stroke velocity according to the material and thickness of the workpiece.

SUMMARY OF THE INVENTION

It is an object of the invention to provide a punch drive apparatus which enables punching with a high speed and reduced noise.

Another object of the invention is to allow the control of velocity and position of punching.

A toggle-type punching drive apparatus of the present invention includes:

a pivoting lever which has the top and the bottom ends connected with a supporting component and a ram respectively and a pivotable pivot point between the two ends;

a shuttle component connected with the pivot point of the pivot lever and a shuttle drive apparatus for making the pivot lever fully stretched at the midpoint of the shuttle stroke; and a ram supported so that it can make up and down motion and drive a punching tool.

In the apparatus described above, the shuttle drive apparatus may include a rotational type drive source and a crank mechanism. Preferably, the shuttle drive apparatus is driven by a servomotor.

In the punching drive apparatus with those components described above, the shuttle movement of the shuttle component forces the pivoting lever to pivot on each side of the stretched position in turn, making the ram go up and downs During the process, when the shuttle component is situated at the one end of the stroke the ram is positioned at the top dead point, then when the shuttle component comes to the midpoint of the stroke the ram goes down to the bottom dead point. As the shuttle component reaches the other end of the stroke, the ram returns to the top dead point. Thus, one shuttle movement of the shuttle component generates two up-down motions of the ram. If the crank mechanism is used for the shuttle drive apparatus of the shuttle component and the rotational velocity of the crank shaft is kept constant, the shuttle component reaches the maximum speed at the midpoint of the stroke with the pivoting lever fully stretched, with the ram pushed down to the bottom dead point. Therefore, a high velocity of the ram near the bottom dead point can be achieved and the punching tool can be moved away with a high velocity after penetrating the workpiece.

When a servomotor is used as the drive source of the shuttle drive apparatus of the shuttle component, the rotational velocity of the crank can be adjusted while the ram goes through one up and bottom motion in which it moves from the top dead point to the bottom dead point then returns from the bottom dead point to the top dead point, making the velocity and position control easier. For example, the velocity and position of the ram can be adjusted according to the material and thickness of the workpiece, allowing improvement of the product quality and reduction of the noise.

DESCRIPTION OF THE PREFERRED EMBODIMENTS

Figure 1:
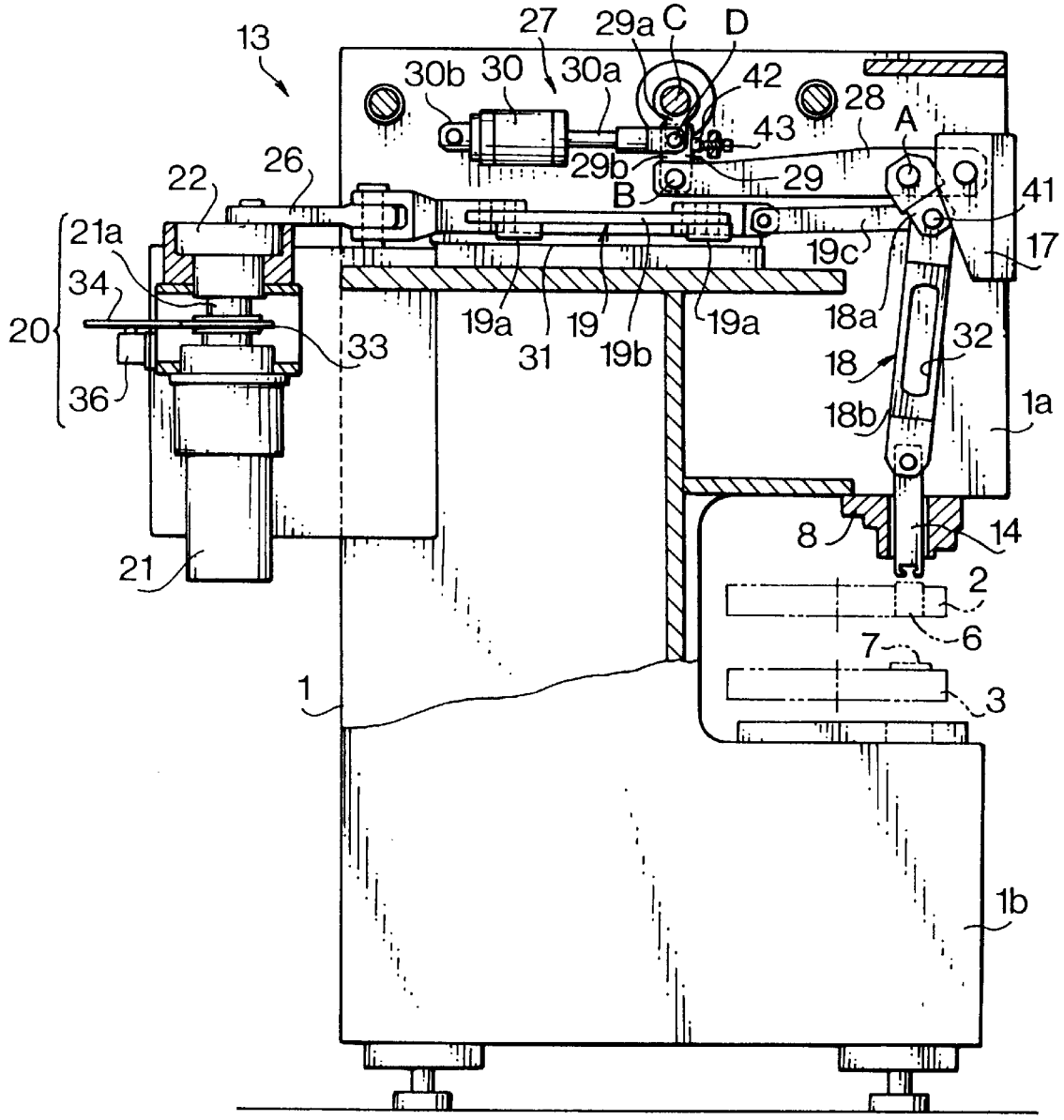
FIG. 1 is a fragmentary sectional side-view showing a punch press machine equipped with the toggle-type punch drive apparatus related to an embodiment of the present invention.
Figure 2:
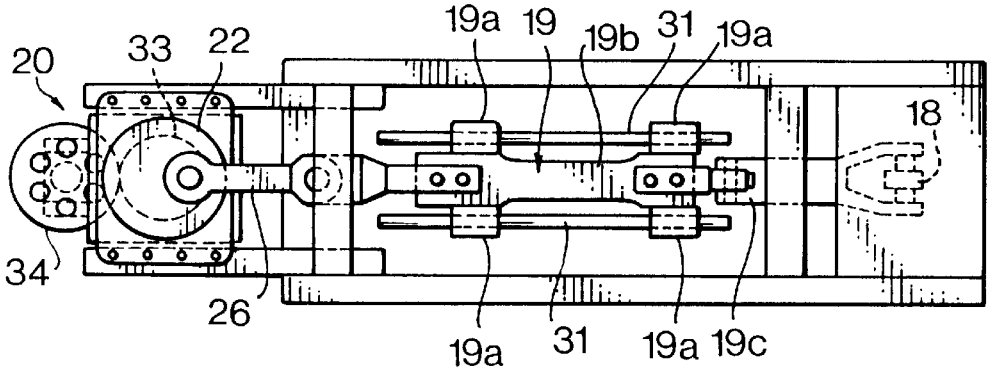
FIG. 2 is a plan view of the punch drive apparatus.
Figure 3:
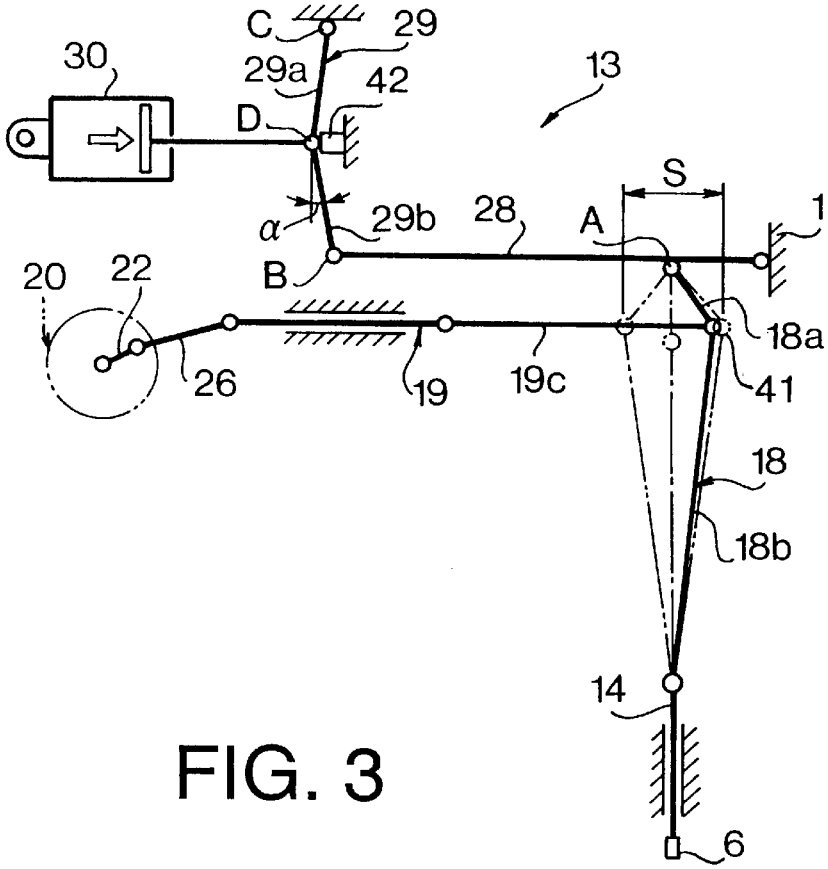
FIG. 3 is a schematic view of the toggle-typed punch drive apparatus.

A preferred embodiment of the present invention will be described with FIG. 1 to FIG. 3. FIG. 1 is a fragmentary sectional side-view of a punching press machine equipped with the toggle-type punch drive apparatus. On a top frame section 1*a* and a bottom frame section 1*b* in the C-shaped frame 1, an upper turret 2 and a lower turret 3 with a plurality of the punching 6 and die 7 tools circularly placed on them are positioned so that they share the same axis. When it is indexed under a ram 14, each of the punching tools 6 is associated with the ram 14 and driven with the up and down motion. The ram 14 is adjustably supported by the upper frame section 1*a* with the assistance of the guide 8, and driven in the up-down motions by the toggle-type punch drive apparatus 13.

In the punch drive apparatus 13 described herein, a pivoting lever 18 that produces the up-down movement of the ram 14 by pivoting motions, is driven and pivoted by a shuttle component 19 that can readily make horizontal shuttle movement, and the shuttle component above is driven by a crank-type shuttle drive apparatus 20 driven by a servomotor 21. The pivoting lever 18 includes a shorter upper lever 18*a* and a longer lower lever 18*b* pivotably connected with a pin 41, and the bottom end of the lower lever 18*b* is rotatably connected with the top end of the ram 14 by way of a pin. An elongated bore 32 is formed in the lower lever 18*b* to reduce the weight of the lever to the extent that it does not lose its strength. The top end of the upper lever 18*a* is rotatably connected with a lever-shaped supporting component 28 with a pin at the supporting point A. The base end of the supporting component 28 is in the vertically rotatable way mounted on a bracket 17 positioned on the upper frame 1*a*, while the top end of the supporting component 28 is supported by an excess load absorbing mechanism 27 which allows up-down movement of the supporting point A and of the punching tools 6 attached to the ram 14 in a manner that the top end of the supporting component 28 can resiliently release an upward excess load.

The shuttle component 19 includes a shuttle main component 19*b* and a shuttle-transfer lever 19*c* wherein the front end of the shuttle main component 19*b* is in the vertically rotational way connected with the shuttle-transfer lever 19*c* while the front end of the shuttle-transfer lever 19*c* is connected with the pin 41 of the bending point of the bending lever 18 in the vertically rotatable way. The up-down motion of the shuttle-transfer lever 19 absorbs the up-down movement of the pivot point by the pivoting motion of the pivoting lever 18. The shuttle main component 19*b* is supported through the guide elements 19*a* by the two parallel guide rails 31, 31 (FIG. 2) provided on the upper frame 1*a* in the way the shuttle main component can readily shuttle on them.

The shuttle driving apparatus 20 includes the servomotor 21, a disk-shaped crank 22 on the output shaft 21*a* of the motor, and a connecting bar 26 of which one end is rotatably connected with an eccentric position of the crank 22, while the other end is rotatably connected with the base end of the shuttle base component 19*b*. Apart from the pulse coder (not shown), a detector 36 that detects the rotatory position of the output shaft 21*a* by way of the gears 33, 34 is provided in the servomotor 21. The detector 36 detects that the ram 14 is situated at the designated stroke position.

The excess load absorbing mechanism 27 includes a second pivoting lever 29, an air cylinder 30 as a resilient supporting mechanism which holds the pivoting lever 29 so that it is pivoted with the minute pivot angle alpha (FIG. 3), and the stopper 42. The second pivoting lever 29 includes the upper lever 29*a* and the lower lever 29*b* associatedly and pivotably connected with a pin at the point of force D which becomes the pivot point. The lower end of the lower lever 29*b* is rotatably connected by way of a pin with the point of action B which is the rear end of the supporting component 28, while the top end of the upper lever 29*a* is rotatably supported by the upper frame 1*a* at the supporting point C.

In the air cylinder 30, the front end of its piston rod 30*a* is rotatably connected with a pin at the pivot point D of the second pivoting lever 29. The base end 30*b* of the air cylinder body 30 is connected with the upper frame 1*a* in the vertically rotatable way. The stopper 42 is engaged with the pivot point of the second pivoting lever 29 and mounted on the upper frame 1*a* by way of a push pull adjusting mechanism 43 having an adjustment screw. The stopper 42 is adjusted so that the pivot angle alpha of the second pivoting lever 29 becomes the designated minute angle.

Now, the operations of the arrangements described above will be explained. One rotation of the crank 22 of the shuttle drive mechanism 20 generates one shuttle movement of the shuttling component 19. During the shuttle movement, as the shuttling component moves from the left end (shown in FIG. 3) to the midpoint of the shuttle stroke S, the pivoting lever 18 changes its left side bent form into a straight one, causing the ram 14 to go down from the top dead point to the bottom dead point. Then as the shuttle component 19 moves from the midpoint to the right end of the shuttle stroke S, the pivoting lever 18 changes its straight form into a right side bent one, causing the ram 14 to go up from the bottom dead point to the top dead point. When the shuttle component returns back from the right end to the left end of the stroke S, the ram goes down and up as described above. Thus, as the shuttle component makes a shuttle movement, the ram repeats two up and down motions, causing two punching motions by the punching tool 6.

In the punching motion described above, since the shuttle component is driven by the crank 22, if the rotation speed of the crank 22 is kept constant then the stroke velocity of the ram 14 reaches the maximum at the midpoint of the stroke and also the difference between the minimum and the maximum velocity becomes large. Therefore, the velocity near the bottom dead point can be maintained high when the punching tool 6 penetrates the workpiece. Further, the servomotor 21 as the drive source of the shuttle component 19 allows adjustment of the rotational velocity of the crank 22 while the ram goes through one up and down motion, in which it moves from the top dead point to the bottom dead point then returns from the bottom dead point to the top dead point, enabling easy control of the velocity and position of the shuttle component 19. Thus, the velocity and position of the ram can be adjusted according to the quality and thickness of the material, achieving the improvement of product quality and the reduction of noise.

For example, the punching tool 6 could be operated with a high speed until immediately before it hits the plate, then with a reduced speed while it is punching the plate. Normally there is a close correlation between the collision velocity of the punching tool 6 against the plate W and the punching noise, and decreasing the collision velocity allows the reduction of the noise. Further, since the punching tool 6 could also be operated with a high speed that compensates the reduced speed above while it is away from the plate, the achievement of a high speed punching process will not be disturbed as a whole.

The excess load which the ram 14 experiences during the punching operation can be released as follows. The punching force working on the supporting point A of the pivoting lever 18 that makes the up and down motion is transferred to the point of action B which is the front end of the supporting component 28. The pushing-up force working on the point of action B is held according to the relationship determined by the position of the supporting point C and the point of force of the second pivoting lever 29, i.e., some force-works on the air cylinder 30 by positioning the pivoting lever 29 as to be not fully stretched but with a minute angle alpha. Since the force (working on the cylinder 30) described above is a component force generated due to the minute pivoting angle alpha from the pressing force working on the bending lever 29 and is quite small, an air cylinder having a large output power is not required. However, if an excess force should work on the pivoting lever 18 that causes the up and down motion, a force larger than the originally intended pressure will work on the air cylinder 30, pushing back its piston. Thus, the excess load working on the pivoting lever 18 that drives the up and down motion can be resiliently absorbed, preventing breakage and damage of the components that would be caused by the excess load otherwise. The pivot angle alpha of the second pivoting lever 29 may be adjusted by pushing or pulling the stopper 42, allowing the adequate prevention of the excess load in accordance with the quality and thickness of the material. In addition, substantially pushing back the piston of the air cylinder 30, for example by, filling air in an air chamber on the right hand side of the piston within the cylinder 30, supporting component 28 and the pivoting lever 18 that drives the up-down motion, allowing the exchange of the punching tool 6 and other labor with the pivoting lever 18 held up as described.

Figure 4:
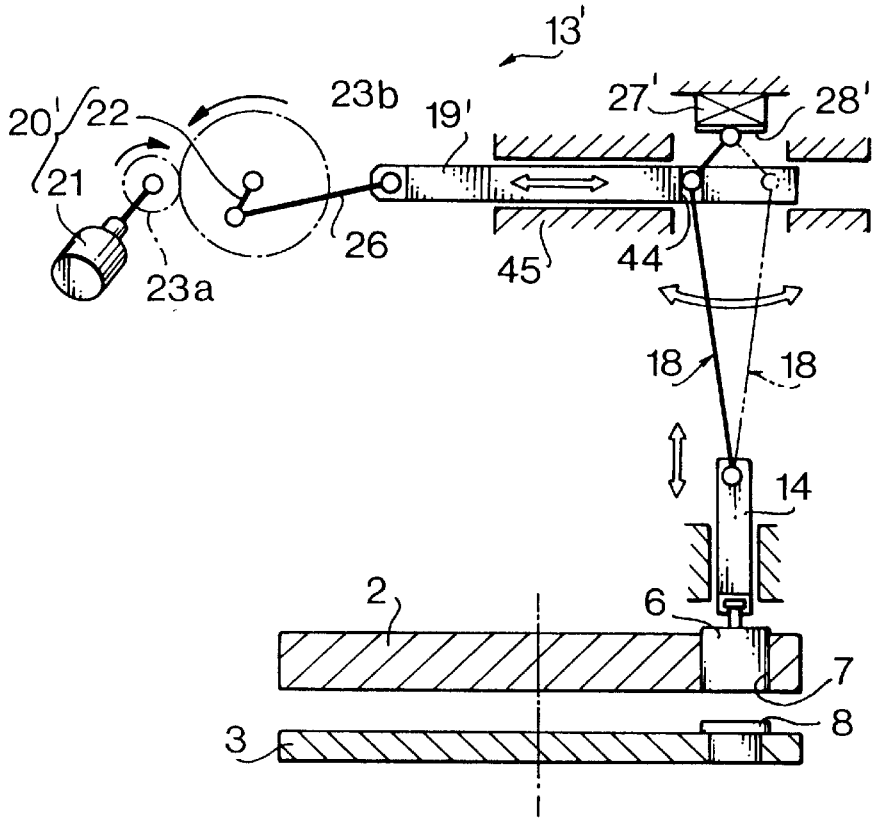
FIG. 4 is a schematic sectional side-view of the punch drive apparatus related to another embodiment of the present invention.
Figure 5:
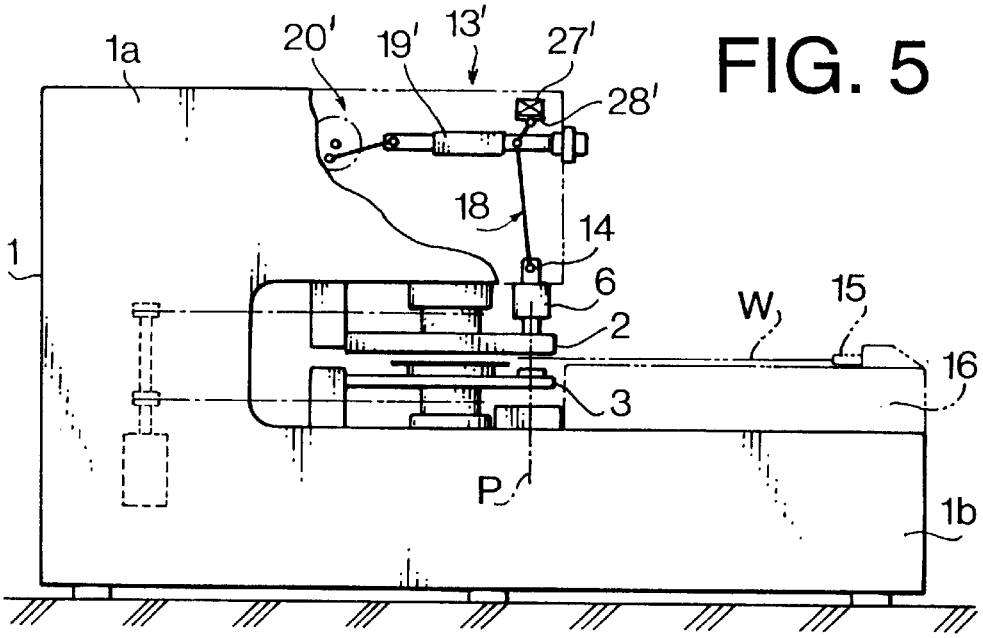
FIG. 5 is a partly sectional side-view of a punch press mechanism equipped with the punch drive apparatus shown in FIG. 4.

FIG. 4 shows a toggle-type punch drive apparatus 13' in accordance with another embodiment of the present invention, and FIG. 5 shows a punch press machine with the toggle type punch drive apparatus 13'. Elements shown in FIGS. 4 and 5 similar to those shown in FIGS. 1, 2 and 3 are designated by the same reference numerals, and the description of these similar elements is omitted. In the embodiments shown in FIGS. 4 and 5, the shuttle component 19' as a single part is mounted on the guide 45 of the upper frame. 1*a* in the way it can readily shuttle therein. The shuttle component 19' is driven by a crank type shuttle drive apparatus 20' that includes a drive gear 23*a* driven by the servomotor and a follower gear 23*b* driven by the drive gear 23*a*. Connecting the shuttle component 19' with the pivoting lever 18 by inserting the pivot point of the pivoting lever 18 through a penetration bore 44 provided in the shuttle component 19', enables absorption of the position change upward and downward of the pivot point of the pivoting lever 18 caused by the pivoting motion of the lever. A supporting component 28' is mounted on the frame 1 through a hard but elastic excess load absorbing mechanism 27' so that the hard but elastic excess load absorbing member 27' is sandwiched between the supporting component 28' and the frame 1. The pivotable lever 18 is pivotally connected to the supporting component 28'. Other components are provided in the same way as the previous embodiment. Further, the plate W held by the workpiece holder 15 of a workpiece feeding mechanism is fed on the table 16 to the punching position P wherein the ram 14 hits it, though the process was not described nor illustrated in the previous embodiment.

What is claimed is:

1. A toggle-type turret punch press machine actuated by a servo motor and having changeable punching tools, comprising:

a vertically moveable ram for driving at least one of the changeable punching tools;

a pivotable lever defining a top end and a bottom end and having an upper lever portion which includes the top end and a lower lever portion which includes the bottom end, the upper lever portion and the lower lever portion being pivotably connected to one another at a pivot point, the top end being rotatably connected with a supporting component, the bottom end being rotatable connected with the ram;

a shuttle component connected to the pivotable lever at the pivot point; and shuttle drive means for driving the shuttle component and pivoting the pivotable lever, the shuttle drive means, defining a shuttle stroke having two end points and a midpoint between the two end points, wherein the pivotable lever is fully extended at about the midpoint of the shuttle stroke, wherein the shuttle drive means includes the servomotor and a crank mechanism for reciprocating the shuttle component between the two end points of the shuttle stroke, wherein the shuttle component comprises a shuttle main member and a shuttle transfer lever means for isolating vertical movement of the pivot point from the shuttle main member, and wherein a guide slidably engages the shuttle main member for horizontally and linearly guiding the shuttle main member, wherein the shuttle transfer lever means has one end pivotally connected to the shuttle main member and another end pivotally connected to the pivotable lever at the pivot point.

2. The toggle-type turret punch press machine of claim 16, wherein the lower lever portion has a bore formed therein.

3. A toggle-type turret punch press machine comprising:

a frame including a support section;

a vertically moveable ram for attachment of at least one changeable punching tool for punching a work piece;

a pivotable lever defining a top end and a bottom end, the top end pivotally connected to the support section of the frame and the bottom end being pivotally connected to the ram, the pivotable lever having an upper lever portion which includes the top end and a lower lever portion which includes the bottom end, the upper lever portion and the lower lever portion being pivotably connected to one another at a pivot point;

a shuttle component, defining a shuttle stroke having two end points and a midpoint between the two end points, and connected to the pivotable lever at the pivot point, wherein the pivotable lever is substantially fully extended at the midpoint of the shuttle stroke; and a rotational drive source, the rotational drive source including a crank member pivotally connected to the shuttle component for reciprocating the shuttle component in a generally horizontal direction between the two end points to thereby pivot the pivotable lever about the pivot point, wherein the shuttle component includes a connecting member having one end pivotally connected to the crank member, a shuttle main member having one end pivotally connected to the connecting member, a guide provided on the frame and slidably engaging the shuttle main member for horizontally and linearly guiding the shuttle main member, and a shuttle transfer lever having one end pivotally connected to the shuttle main member and another end pivotally connected to the pivotable lever at the pivot point.

4. The toggle-type turret punch press machine of claim 3, wherein the crank member is rotated at a generally constant rotational velocity to reciprocate the shuttle component between the two end points of the shuttle stroke so that the shuttle component reaches a maximum speed at about the midpoint of the shuttle stroke and a minimum speed at each of the two end points of the shuttle stroke.

5. The toggle-type turret punch press machine of claim 4, wherein the ram defines a punching stroke between a top dead point and a bottom dead point, and the ram reaches the bottom dead point when the pivotable lever is substantially fully extended at the midpoint of the shuttle stroke.

6. The toggle-type turret punch press machine of claim 3, further comprising an excess load absorbing mechanism mounted on the frame, wherein the pivotable lever is connected to the excess load absorbing mechanism for resiliently absorbing an excess load on the pivotable lever which occurs during a punching operation.

7. A toggle-type turret punch press machine comprising:

a frame including a support section;

a vertically moveable ram for attachment of at least one changeable punching tool for punching a work piece;

a first pivotable lever defining a top end and a bottom end, the top end pivotally connected to the support section of the frame and the bottom end being pivotally connected to the ram, the first pivotable lever having an upper lever portion which includes the top end and a lower lever portion which includes the bottom end, the upper lever portion and the lower lever portion being pivotably connected to one another at a first pivot point;

a shuttle component defining a shuttle stroke having a two end points and a midpoint between the two end points, and connected to the first pivotable lever at the first pivot point, wherein the first pivotable lever is substantially fully extended at the midpoint of the shuttle stroke; and a rotational drive source the rotational drive source, including a crank member pivotally connected to the shuttle component for reciprocating the shuttle component in a generally horizontal direction between the two end points to thereby pivot the first pivotable lever about the first pivot point; and an excess load absorbing mechanism mounted on the frame, wherein the first pivotable lever is connected to the excess load absorbing mechanism for resiliently absorbing an excess load on the first pivotable lever which occurs during a punching operation, wherein the excess load absorbing mechanism comprises a second pivotable lever defining a top end pivotally connected to the frame and a bottom end, the second pivotable lever including a first lever portion which includes the top end of the second pivotable lever and a second lever portion which includes the bottom end of the second pivotable lever, the first lever portion and the second lever portion being pivotally connected to one another at a second pivot point, the first lever portion and the second lever portion being bent about the second pivot point at a specified angle, a supporting lever having one end pivotally connected to the frame and another end pivotally connected to the bottom end of the second pivotable lever, the top end of the first pivotable lever being pivotally connected to the supporting lever, and a cylinder having a plunger pivotally connected to the second pivotable lever at the second pivot point.

8. The toggle-type turret punch press machine of claim 7, further comprising an adjustable stopper connected to the excess load absorbing pivotable lever for adjusting the specified angle defined between the first lever and the second lever and stopping the plunger of the cylinder.

* * * * *